United States Patent [19]

Van Delm et al.

[11] Patent Number: 4,981,330

[45] Date of Patent: Jan. 1, 1991

[54] HIGH-PRESSURE SODIUM VAPOR DISCHARGE LAMP

[75] Inventors: Marc G. A. M. Van Delm; Franciscus N. G. R. van der Kruijs, both of Turnhout, Belgium

[73] Assignee: U.S. Philips Corporation, New York, N.Y.

[21] Appl. No.: 354,068

[22] Filed: May 18, 1989

[30] Foreign Application Priority Data

Jun. 6, 1988 [NL] Netherlands ..... 8801442

[51] Int. Cl.[5] ..... H01J 7/44

[52] U.S. Cl. ..... 315/47; 315/60; 315/73

[58] Field of Search ..... 315/47, 56, 60, 61, 315/72, 73, 74; 313/318, 619

[56] References Cited

U.S. PATENT DOCUMENTS 4,498,030 2/1985 Goouerts et al. ..... 315/60

FOREIGN PATENT DOCUMENTS 1340551 12/1973 United Kingdom .

*Primary Examiner*—Robert J. Pascal

*Attorney, Agent, or Firm*—Brian J. Wieghaus

[57] ABSTRACT

A high-pressure sodium vapor discharge lamp having a discharge vessel in which main electrodes are arranged and an ignition system which comprises an electric conductor surrounding the discharge vessel over at least a part of its circumference, which conductor is electrically connected to a main electrode at least in the inoperative state of the lamp. The electric conductor is a clamping member clamping around the discharge vessel. A fixed, arcuate positioning of the electric conductor is thus obtained.

5 Claims, 1 Drawing Sheet

HIGH-PRESSURE SODIUM VAPOR DISCHARGE LAMP

Figure 1:
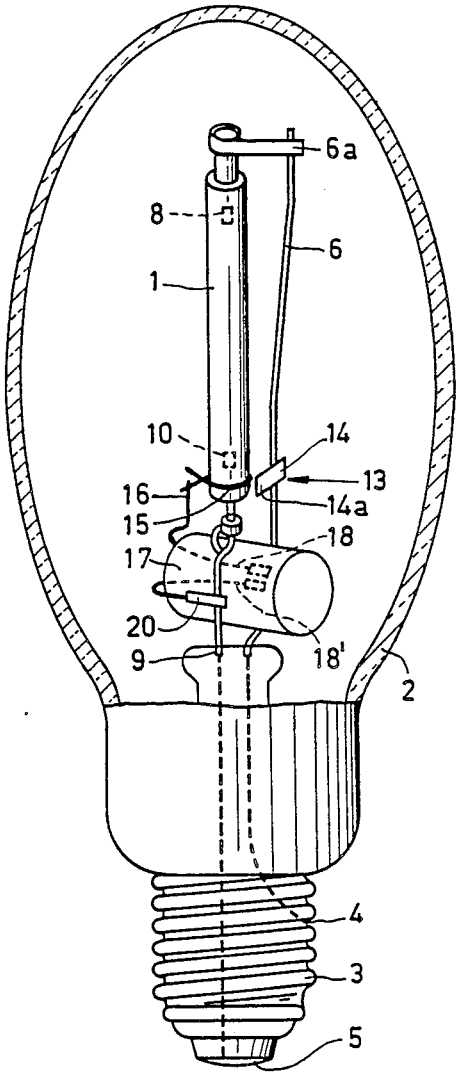

The invention relates to a high-pressure sodium vapour discharge lamp having a discharge vessel of a ceramic material in which main electrodes are arranged opposite to each other, the lamp having an ignition system which comprises an electric conductor surrounding the discharge vessel over at least a part of its circumference, said conductor being electrically connected to a main electrode at least in the inoperative state of the lamp.

In this respect ceramic material is understood to mean a material comprising a sodium vapor-resistant crystalline oxide such as, for example monocrystalline sapphire or polycrystalline densely sintered aluminium oxide. In addition to sodium and one or more rare gases the discharge vessel may also contain mercury. The inoperative state of the lamp is understood to mean the situation in which there is no discharge between the main electrodes and the operative state of the lamp is the situation in which a stable arc discharge is maintained between the main electrodes.

A lamp of the type described above is known from U.S. Pat. No. 4,498,030 (PHN 10.212).

In the known lamp the ignition system not only comprises the electric conductor but also a bimetal switch and a glow discharge starter switch. The conductor constitutes the electrical connection in the series circuit of the glow discharge starter switch and the bimetal switch and to this end it is wound around one end of the discharge vessel during the manufacture of the lamp. The electric conductor thus functions as the contact for the bimetal switch. In the operative state of the lamp the contact between the bimetal switch and the electric conductor is interrupted by means of the bimetal switch so that not only the electric conductor but also the glow discharge starter switch is electrically switched off. The glow discharge starter switch then cannot become operative, so that the satisfactory operation of the lamp is not detrimentally influenced.

In another known lamp of the type described, known from British Patent Specification No. 1,340,551 (PHN 4723), the electric conductor is used as an ignition electrode. In this case it is important that the conductor, which is clear of the discharge vessel, is present at an accurately defined position around the circumference of the discharge vessel. It is feasible that a bimetal switch is arranged between the conductor and the relevant main electrode, with which switch the conductor is electrically switched off in the operative state of the lamp. This is favorable because migration of constituents of the filling of the discharge vessel is then prevented.

An accurate positioning of the electric conductor, Which positioning remains fixed also during the lifetime of the lamp, yields problems in practice. It has been found that in lamps in which the electric conductor operates as a contact for the bimetal switch the electrical contact between the two leaves much to be desired in the course of the lifetime of the lamp. In lamps in which the electric conductor operates as an ignition electrode it has been found that the ignition voltage is detrimentally modified during the lifetime of the lamp.

It is an object of the invention to provide a means to obviate the described problems which are due to an inaccurate position of the conductor, while maintaining the other lamp properties.

According to the invention, in a lamp of the type described in the opening paragraph this object is realized in that the electric conductor is a clamping member clamping around the discharge vessel.

In this way it is achieved that the electric conductor occupies a fixed position on the discharge vessel and in that it is prevented from sliding with respect to the discharge vessel during the lifetime of the lamp. This means that the electric conductor remains satisfactorily positioned with respect to the bimetal switch, thus maintaining a satisfactory operation of the electric contact mechanism between them. If the electric conductor operates as an auxiliary electrode during the ignition of the lamp, this means that the distance between the auxiliary electrode and the relevant main electrode remains constant during the lifetime of the lamp so that the ignition voltage is not detrimentally influenced.

An advantageous embodiment of a lamp according to the invention is characterized in that the clamping member is a resilient wire piece which is bent around the discharge vessel at least through an angle of more than 180°.

This provides a simple and inexpensive construction.

In a further advantageous embodiment of a lamp according to the invention the wire piece is bent around the discharge vessel through an angle of more than 540° but not more than 900°.

Such a construction in which the wire piece has a number of turns of between approximately 1.5 and 2.5 has the advantage that a satisfactory and reliable clamping of the wire piece around the discharge vessel is obtained under all practical circumstances, thus also under those circumstances in which the discharge vessel does not have a purely circular cross-section. If the wire piece is used as a contact for a bimetal switch, the use of more than one turn, for example two, provides the additional advantage that the extra turn has a favorable influence on the transfer of heat between the discharge vessel and the bimetal switch. When the lamp becomes operative, the bimetal switch is heated faster due to improved thermal conductivity caused by the extra turn and switches off faster.

The resilient wire piece is preferably provided with ends diverging with respect to each other at least over a part of their length so that the bent portion of the wire piece increases in diameter simply by pressing the ends towards each other. This makes it very easy to provide such resilient wire pieces around discharge vessels and it makes them highly insensitive to tolerances in dimensions of the discharge vessels.

The wire piece preferably consists of tungsten, niobium, tantalum or molybdenum. A wire piece of these metals can be relatively easily bent to form a clamping member. Moreover, the metals are satisfactorily resistant to heat so that a clamping member thus formed maintains its resilience at the temperatures occurring in the lamp.

Figure 2:
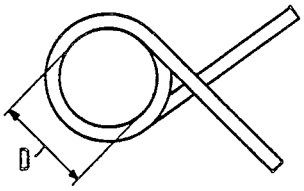

An embodiment of a lamp according to the invention will be described in greater detail with reference to the accompanying drawing in which FIG. 1 is a side elevation of a high-pressure sodium vapor discharge lamp;

FIG. 2 shows an embodiment of a clamping member in a side elevation.

In FIG. 1 the reference numeral 1 denotes a discharge vessel of a ceramic material, which is enclosed by an outer envelope 2 having a lamp cap 3. The lamp cap 3 has two terminals 4 and 5. Terminal 5 is connected to one end of a rigid current conductor 9. The other end of current conductor 9 leads to a first main electrode 10 of the discharge vessel 1. Terminal 4 is connected to one end of a rigid current conductor 6. The other end of current conductor 6 is connected to a current conductor 6a leading to a second main electrode 8 of the discharge vessel 1. A bimetal element 14 of bimetal switch 13 is secured to the current conductor 6.

An electric conductor 15 in the form of a clamping member clamps around the discharge vessel 1. The conductor 15 consists of a resilient wire piece of, for example molybdenum which is bent around the discharge vessel 1 through an angle of approximately 360°. The bent wire piece is formed before it is mounted around the discharge vessel. By pressing the crossing free ends of the bent wire piece towards each other, its inner diameter increases so that the wire piece can then be easily slid on the discharge vessel. When releasing the free ends, they spring back so that the inner diameter decreases and the wire piece clamps around the discharge vessel.

The electric conductor 15 constitutes the contact of the bimetal switch 13. Since the electric conductor 15 clamps around the discharge vessel 1 and is resistant to heat, it remains well positioned with respect to the bimetal switch 13 during the lifetime of the lamp so that a good operation of the electric contact mechanism between the two is maintained.

A terminal 18 of a glow discharge starter switch 17 is connected to a free end of the electric conductor 15 via a flexible wire-shaped conductor 16. Possible variations in the mutual distance between clamping member 15 and glow discharge starter switch 17, which may occur, for example under the influence of thermal expansion, are compensated for by the flexible conductor 16. Another terminal 18' of the glow discharge starter switch 17 is connected to the current conductor 9 by means of conductor 20.

In the inoperative or extinguished state of the lamp one end 14a of the bimetal element 14 engages the clamping member 15. In the operative or burning state of the lamp the bimetal element 14 is remote from the discharge vessel and thereby interrupts the contact with the clamping member 15, thus electrically switching off the glow discharge starter switch 17.

The operation of the lamp described will hereinafter be explained in greater detail. If the lamp is connected to a voltage source via a stabilization ballast, a glow discharge will be firstly produced in the glow discharge starter switch 17. This produces heat so that the two contacts in the glow discharge starter will close after some time. A current will then start to flow in the circuit 4, 6, 14, 15, 16, 18, 18', 20, 9, 5. The glow discharge starter switch will now cool off again so that after some time its contacts will move away from each other. This switching off of the glow discharge starter switch produces a voltage pulse of approximately 2000 V which will be present between the main electrodes 8 and 10 via the contact 15 and the bimetal element 14. Consequently, an electric field is generated in the discharge vessel at which the discharge between the main electrodes 8 and 10 ignites. If this does not happen for the first time, the procedure with the glow discharge starter switch is repeated.

The lamp may have an external ignition electrode which is secured in an electrically conducting manner, for example between the current conductor 6 and the end 14a of bimetal element 14.

In one embodiment of a lamp according to the invention the filling of the discharge vessel consists of approximately 15 mg of amalgam comprising 3 mg of sodium and 12 mg of mercury, and xenon which has a pressure of $3.3.10^3$ Pa (25 torr) at 300 K. The lamp is suitable to be operated by a supply source of 220 V, 50 Hz via a stabilization ballast of 0.5 H dissipating a power of approximately 70 W. The length of the discharge vessel is approximately 57 mm and the distance between the main electrodes is approximately 35 mm. The discharge vessel has a wall thickness of 0.6 mm and an outer diameter of 5.0 mm.

FIG. 2 shows a clamping member in the form of a resilient bent wire piece which is a modification of the electric conductor 15 of FIG. 1.

The wire piece is bent through an angle of approximately 640°, which corresponds to approximately 1.8 turns. In a practical embodiment the wire piece consists of molybdenum and has a wire diameter of 500 μm and an inner diameter D of 4.5 mm. This clamping member is suitable for use in the above-described embodiment of the lamp of approximately 70 W in which the discharge vessel has an outer diameter of 5.0 mm. The bent wire piece is clamped around the discharge vessel by first pressing the free ends towards each other so that the inner diameter D increases, subsequently by sliding the wire piece on the discharge vessel until the correct position has been reached and then by releasing the free ends.

It has been found in practice that the increase of the inner diameter D required to slide the wire piece on the discharge vessel becomes a problem when pressing the free ends of the wire piece towards each other if a wire piece is bent through more than 900° (approximately 2.5 turns).

Other embodiments of the clamping member are of course also possible, for example a clamping bush or a clamping ring.

We claim:

1. A high-pressure sodium vapor discharge lamp having a discharge vessel of a ceramic material in which main electrodes are arranged opposite to each other, the lamp having an ignition system which comprises an electric conductor surrounding the discharge vessel over at least a part of its circumference, said conductor being electrically connected to a main electrode at least in the inoperative state of the lamp, characterized in that the electric conductor is a clamping member clamping around the discharge vessel.

2. A high-pressure sodium vapour discharge lamp as claimed in claim 1, characterized in that the clamping member is a resilient wire piece which is bent around the discharge vessel at least through an angle of more than 180°.

3. A high-pressure sodium vapor discharge lamp as claimed in claim 2, characterized in that the wire piece is bent around the discharge vessel through an angle of more than 540° but not more than 900°.

4. A high-pressure sodium vapor discharge lamp as claimed in claim 3, characterized in that the resilient wire piece has ends diverging with respect to each other at least over a part of their length.

5. A high-pressure sodium vapor discharge lamp as claimed in claim 2, characterized in that the resilient wire piece has ends diverging with respect to each other at least over a part of their length.

* * * * *